US005664710A

United States Patent [19]

Lam

[11] Patent Number: 5,664,710

[45] Date of Patent: Sep. 9, 1997

[54] GARMENT HANGER

[76] Inventor: Peter Ar-Fu Lam, 20104 Wayne Ave., Torrance, Calif. 90503

[21] Appl. No.: 600,402

[22] Filed: Feb. 12, 1996

Related U.S. Application Data

[63] Continuation-in-part of Ser. No. 201,539, Feb. 25, 1994, Pat. No. 5,511,701.

[30] Foreign Application Priority Data

Feb. 20, 1995 [EP] European Pat. Off. ..... 95301062

[51] Int. Cl.[6] ..... A47G 25/40; A47G 25/14

[52] U.S. Cl. ..... 223/94; 223/89; 223/85

[58] Field of Search ..... 223/94, 89, 85, 223/92, 95, 88; 40/322; D6/315, 324

[56] References Cited

U.S. PATENT DOCUMENTS

| | | | |
|---|---|---|---|
| 2,477,873 | 8/1949 | Hopkins et al. | 223/89 |
| 3,024,954 | 3/1962 | Michlin | 223/95 |
| 3,834,598 | 9/1974 | Matsumoto | 223/89 |
| 4,198,773 | 4/1980 | Batts et al. | 40/322 |
| 5,044,535 | 9/1991 | Hunt | 223/89 |
| 5,102,019 | 4/1992 | Lam | 223/89 |
| 5,511,701 | 4/1996 | Lam | 223/85 |

*Primary Examiner*—Bibhu Mohanty

[57] ABSTRACT

An adjustable garment hanger (688) is disclosed having extension members (664, 666) which move laterally from a medial portion (650). The extension members move as a result of engagement between a pair of tongues (668, 670) and medially disposed pinions (658, 660). Disclosed embodiments include manual adjustment knobs (380) and bidirectional electric motors (402) coupled to the pinion. Embodiments also include apparatus for indicating hanger size obtained by movement of the extension members.

23 Claims, 8 Drawing Sheets

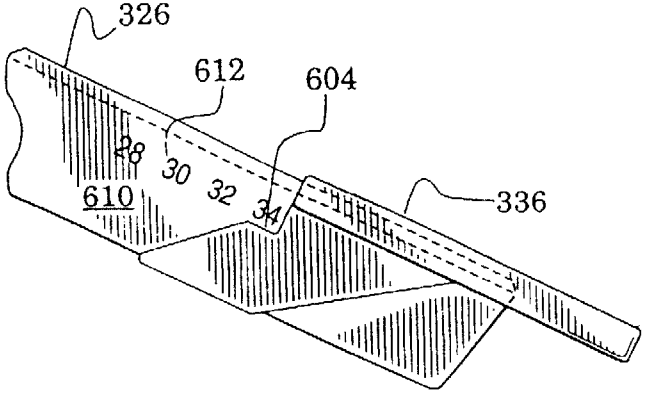
FIG. 20
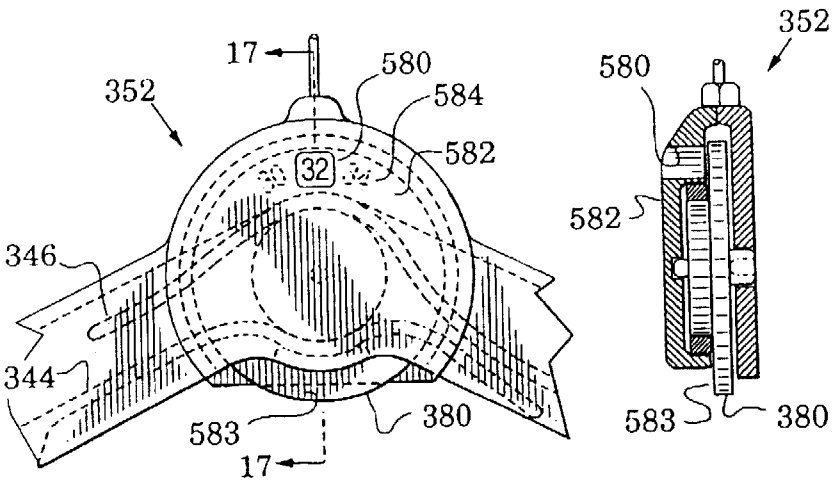
FIG. 17
FIG. 16
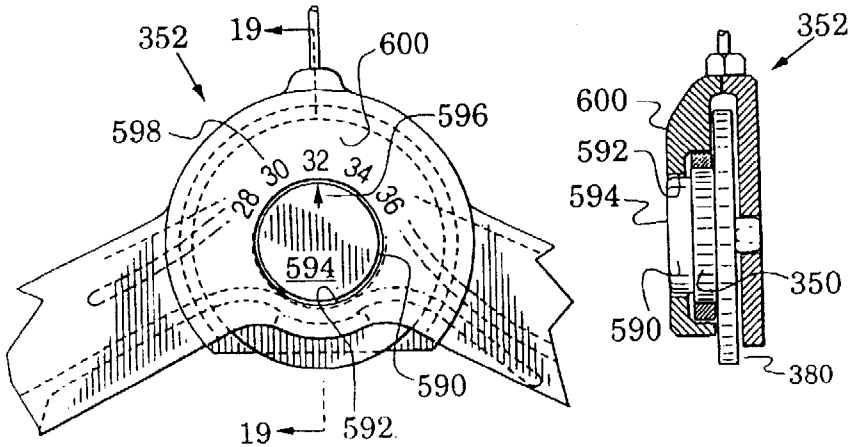
FIG. 19
FIG. 18

GARMENT HANGER

RELATED APPLICATIONS

This is a continuation in part of U.S. application Ser. No. 08/201,539 filed Feb. 25, 1994, now U.S. Pat. No. 5,511, 701. Priority benefit of the prior European Patent Application 95301062.6 filed Feb. 20, 1995 (published Sep. 6, 1995; publication number 0670133A1) is claimed. These two applications are incorporated herein by reference.

FIELD OF THE INVENTION

The present invention relates to garment hangers.

BACKGROUND OF INVENTION

Garments are optimally displayed and maintained on hangers sized appropriately to the garment. A garment manufacturer or retailer can achieve this either by using differently sized fixed width hangers or by using adjustable width hangers. Similarly, an end user could adopt a particularly sized fixed width hanger or selectively adjust an adjustable width hanger to his garment size.

The prior art is replete with various configurations of garment hangers which incorporate structure for selectively adjusting the hanger's width to accommodate different size garments. Applicant's pending EPO Patent application 95301062.6, U.S. application Ser. No. 08/201,539, U.S. Pat. Nos. 5,085,358 and 5,102,019 disclose some such structures as do certain ones of the references U.S. Pat. Nos. 3,024,954, 5,044,535, 2,477,873, European patents DE-C-286 192, WO-A-94 02056, DE-U-88 04 572 and DE-A-40 07 320 cited therein.

SUMMARY OF THE INVENTION

The present invention is directed to garment hangers incorporating improved structures for adjusting the hanger's width and/or indicating the garment size to be accommodated on the hanger.

According to one aspect of the present invention there is provided an adjustable garment hanger having first and second elongated support arms, a transfer mechanism; and first and second extension members mounted respectively for translation along the first and second support arms. The first and second support arms are supported relative to one another at an obtuse angle therebetween; and in that each of the extension members couples to the transfer mechanism for reciprocal translation of the extension members along their respective support arms.

In one preferred embodiment of an adjustable garment hanger in accordance with the present invention when force is applied on the first extension arm in the direction along the axis of the respective first support arm, the force is translated to the second extension arm for reciprocal motion of the second extension arm along the second support arm.

In another preferred embodiment the transfer mechanism is at least one wheel and in that each of the extension members includes a tongue coupled to the wheel for reciprocal translation of the extension members along their respective support arms.

In a further preferred embodiment means are provided for guiding each of the tongues along a path that is tangent with the wheel for engagement thereof. Conveniently, each of the paths includes a first segment substantially aligned with one of the support arms and a second segment substantially aligned with the other of the support arms. Moreover, the tongue of each extension member is preferably a flexible tongue.

In an alternative embodiment means are provided for indicating the hanger size obtained by the reciprocal translation of the first and second extension members along their respective support arms. Preferably, the indicating means includes rotational means for indicating the predetermined size.

In another alternative embodiment, an adjustment knob is coupled to the wheel to facilitate manual turning thereof for translation of the extension members. Conveniently, an electric motor is provided for driving the wheel.

In a further embodiment there are provided at least first and second wheels mounted approximate to the medial portion between the support arms for rotation; the first extension member being coupled to the first wheel; said second extension member being coupled to the second wheel; and the first wheel coupled to the second wheel for reciprocal translation of the extension members along their support arms.

In yet a further embodiment a transfer mechanism preferably comprising at least a first wheel mounted approximal to the medial portion for rotation; each of the extension members having an inner end and an outer end, the movement paths of the inner end of the extension members cross over each other side by side at a location proximal to the medial portion; and the inner ends of each extension member is coupled to the transfer mechanism for reciprocal translation of the extension members along their support arms. Conveniently, there are provided two wheels mounted for rotation on spaced apart axes and with peripheral coupling therebetween; and a substantially non-flexible tongue extending from each of the first and second extension members to contact a respective one of the wheels, the tongues being arranged to cross-over in the medial portion when the extension members are at their innermost position on the support arms. Advantageously, in any of the embodiments the wheels or the first wheel includes a plurality of peripherally defined teeth and each inner end of the extension members defines a plurality of teeth. Although the tongues of each extension members is preferably to be of a rigid structure for this embodiment, it can also comprise a flexible region.

According to another aspect of the present invention there is provided a method of forming an adjustable garment hanger, comprising the steps of arranging first and second elongate support arms to define an obtuse angle therebetween; rotatably mounting at least one wheel in operative association with the arms; mounting first and second extension members on the first and second arms respectively for translation therealong; and providing a tongue on each of the extension members respectively to engage the translation means for reciprocal translation of the extension members along their respective support arms.

BRIEF DESCRIPTION OF DRAWINGS

FIG. 16 is a view of the medial portion of FIG. 8 illustrating a size indication apparatus therein;

FIG. 17 is a side view of FIG. 16;

FIG. 18 is a view similar to FIG. 16 illustrating another size indication apparatus;

FIG. 19 is a side view of FIG. 18; and

FIG. 20 is a view of one end of FIG. 8 illustrating another size indication apparatus.

DESCRIPTION OF THE PREFERRED EMBODIMENTS

Figure 1:
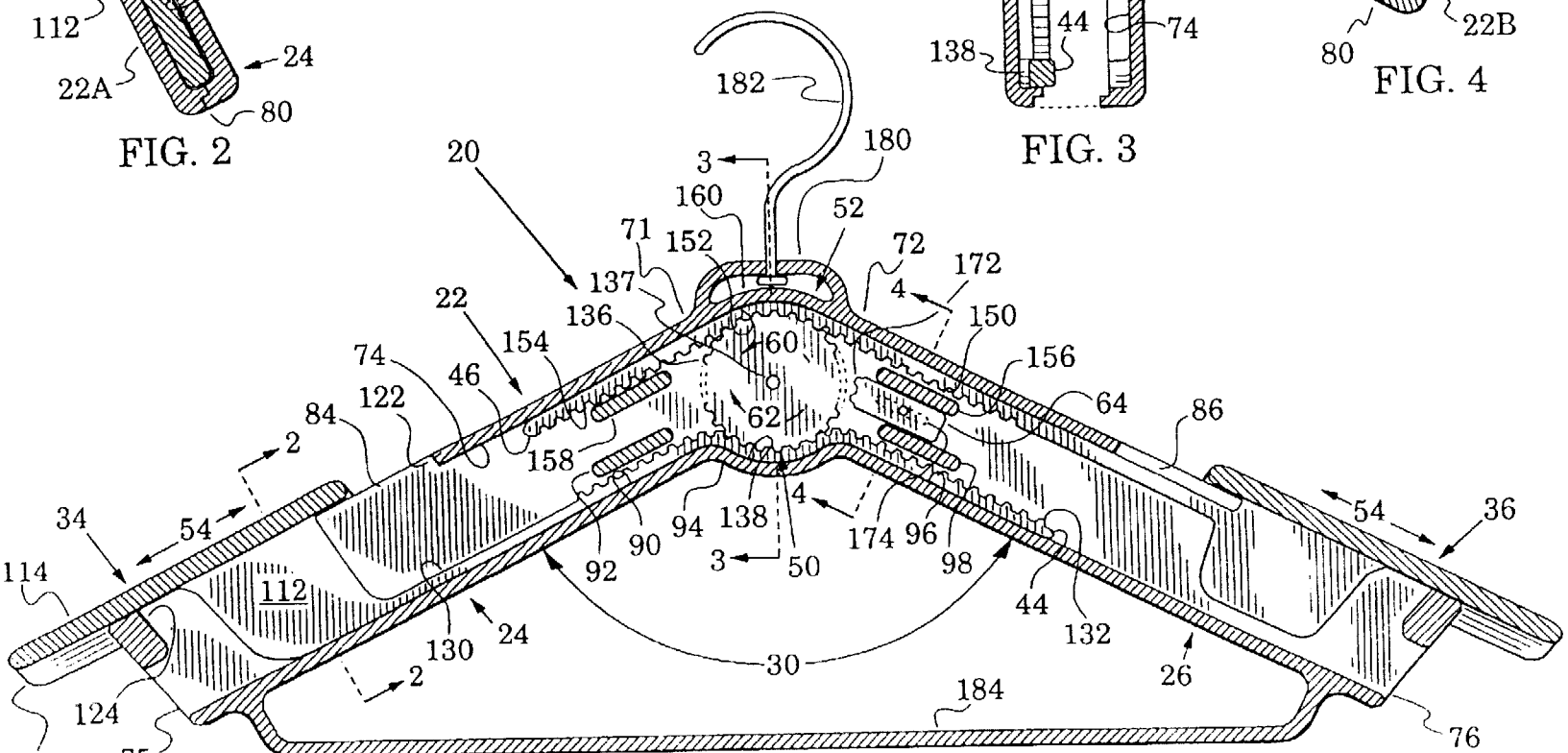
FIG. 1 is an elevation view of an adjustable garment hanger showing a preferred embodiment in accordance with the present invention.

FIG. 1 is an elevation view illustrating a preferred adjustable hanger embodiment 20 in accordance with the present invention. The hanger 20 includes a frame 22 having a pair of elongate support members in the form of arms 24, 26. The arms 24, 26 are arranged to define an obtuse angle 30 therebetween and respectively carry slidable extension members 34, 36. The extension members respectively have flexible racks 44, 46 extending therefrom which are guided to engage a pinion gear 50 rotatably mounted at a medial portion 52 of the frame 22. The flexibility of the racks 44, 46 allow each of them to follow a respective guide path that is tangent to the pinion 50 and which includes path segments substantially parallel to each of the arms 24, 26.

Thus, each extension member 34, 36 can be reciprocally translated along its respective arm as indicated by double headed arrows 54. Movement of the extension members 34, 36 can be accomplished by grasping each in one hand and urging them inward or outward. Alternatively, the frame can be grasped in one hand and either of the extension members urged inward or outward with the other hand. Engagement of each flexible rack 44, 46 with the pinion 50 insures that any change in the spacing of one extension member from the frame medial portion 52 is accompanied by an equal change in the spacing of the other extension member, i.e., the extension members 34, 36 are reciprocally and oppositely translated on their respective arms 24, 26.

If the extension members 34, 36 are urged towards the medial frame portion 52, the pinion 50 rotates in the angular direction 60 and if they are urged away from the medial frame portion 52, the pinion 50 rotates in the angular direction 62. Friction between the parts of the hanger 20 will generally cause the extension members 34, 36 to remain stationary when not being adjusted. However, this can be assured with a position locking member in the form of a pawl 64 that can be selectively slid into locking engagement with the pinion 50.

A hanger 20 is, therefore, provided which can be quickly and easily adjusted to a lateral spacing between extension members 34, 36 that most effectively supports a chosen garment. The extension members 34, 36 are simply urged inward or outward by hand as necessary to best fit and support the garment and they remain in the desired spacing until readjusted for another garment. The hanger can be fabricated with an obtuse angle 30, between the arms 22, 24, that best accommodates and supports a chosen garment type, e.g., coats.

Figure 4:
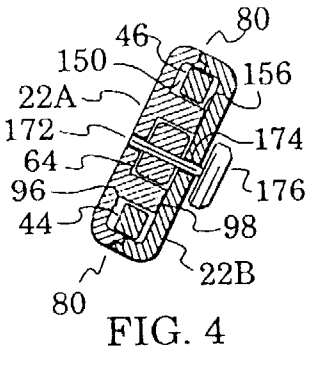
FIG. 4 is an enlarged sectional view along the plane 4—4 of FIG. 1.
Figure 3:
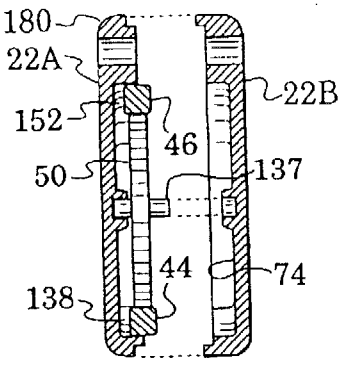
FIG. 3 is an enlarged sectional view along the plane 3—3 of FIG. 1.
Figure 2:
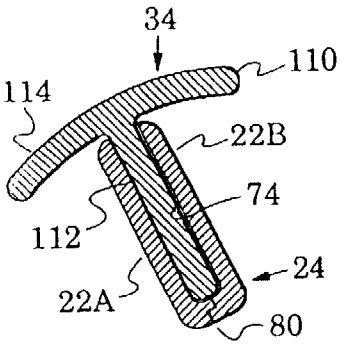
FIG. 2 is an enlarged sectional view along the plane 2—2 of FIG. 1.

Directing attention now to a more detailed disclosure of the preferred embodiment relative to FIGS. 1–4 (FIGS. 2, 3 and 4 are respectively views along planes 2—2, 3—3 and 4—4 of FIG. 1), it is seen that the frame 22 defines the arms 24, 26 and a medial frame portion 52. The arms 24, 26 are arranged to define the obtuse angle 30 therebetween and each is respectively joined at an interior end 71, 72 to the medial portion 52. The frame 22 is in the form of a hollow housing which defines an interior chamber 74 extending laterally between the respective outer ends 75, 76 of the arms 24, 26. The frame 22 may be formed, for example, of two halves 22A, 22B which are molded of a polymer and bonded together along a laterally arranged partition line 80. A pair of laterally directed slots 84, 86 are defined respectively along the top of the arms 24,26 to communicate with the chamber 74.

A passage 90 is formed by spacing a boss 92 from the lower chamber wall 94. A similar passage 96 is formed by spacing another boss 98 from the lower chamber wall 94. The bosses 92, 98 are spaced oppositely from the medial portion 52 so that the passages 90, 96 are aligned to be respectively substantially parallel with the arms 24, 26.

As shown in FIGS. 1 and 2, the extension member 34 includes a garment abutting member 110 arranged orthogonally with a plate 112. The garment abutting member 110 is suitably formed to carry a garment in ways well known in the hanger art. For example, the member 110 can define an upper arcuate surface 114, as shown in FIGS. 1 and 2, to conformingly support the interior of a coat shoulder. Alternatively, the member 110 could define a hook to support a dress shoulder strap.

The plate 112 is received through the slot 84 to slide laterally within the chamber 74. The extension member 34 is thus slidably carried for reciprocal movement along the arm 24 as indicated by the arrow 54. The slot 84 extends between interior and exterior ends 122, 124 which thus form stops to abut and limit the lateral travel of the extension member 34.

A long flexible tongue 130 extends laterally inward from the lower terminus of the plate 112. The upper surface of the tongue 130 defines a plurality of spaced teeth 132 so that the tongue 130 and teeth 1 32 together form the above mentioned flexible rack 44.

The pinion 50 defines a plurality of spaced teeth 136 configured to rotatably engage the rack teeth 132. The pinion 50 is rotatably mounted on a shaft 137 carried between the frame halves 22A, 22B in the medial frame portion 52. The frame medial portion 52 is configured and the pinion 50 is dimensioned and positioned in the medial portion 50 to form therebetween an arcuate passage 138 which is located between the passages 90, 96.

The extension member 34 is installed in the frame 22 with the flexible rack 44 arranged to successively extend through the passages 90, 138 and 96. As the flexible rack 44 is fed through the passage 138 its teeth 132 engage the pinion teeth 136. If the extension member 34 is now slid towards the medial portion 52, the flexible rack 44 slides through the passages 90, 138 and 96 and causes the pinion 50 to rotate in the direction 60. If the extension member 34 is slid away from the medial portion 52, the flexible rack 44 slides through the passages 90, 138 and 96 and causes the pinion 50 to rotate in the direction 62. Thus, the flexible rack 44 can reciprocally move along a path to engage the pinion 50 wherein the above mentioned path includes the passages 90, 138 and 96 and wherein the path segments defined by the passages 90, 96 are respectively substantially aligned with the arms 24, 26.

The extension member 36 is carried by the frame 22 in a manner similar to that described above for the extension member 34 except that the extension member 36 is slid through the slot 86 with its flexible rack 46 successively passed through passages 150, 152 and 154. Passages 150 and 154 are respectively formed by bosses 156, 158 spaced from the upper chamber wall 160 and spaced oppositely from the medial portion 52. The arcuate passage 152 is formed by the space between the pinion 50 and the upper chamber wall 160.

The flexible racks 44, 46 therefore engage the pinion 50 along diametrically opposed portions thereof and each move along a respective path. Each path includes path segments laterally spaced from the pinion 50 and respectively aligned with the arms 24, 26. Each path also includes an arcuate path segment radially spaced from the pinion 50, i.e., the passages 138, 152.

In use of the hanger 20, the user may grasp each extension member 34, 36 and urge them inward or outward to effect lateral movement along the arrows 54 (shown in FIG. 1). The pinion 50 will turn in accordance with the lateral movement of the racks 44, 46. That is, if the extension members are urged inward, the pinion 50 rotates in the direction 60 and if they are urged outward it rotates in the direction 62.

Alternatively, a user may grasp the frame 22 with one hand while urging one of the extension members towards or away from the medial portion 52. The lateral urging of that extension member's rack will be translated via the pinion 52 into lateral urging of the other rack. Consequently, the opposite extension member will move in accordance with the first extension member, i.e., urging extension member 34 inward will cause extension member 36 to move inward at the same rate.

The obtuse angle 30 between the arms 24, 26 is necessary if the hanger 20 is to effectively support garments, e.g., coats, shirts, dresses, whose shoulder portions (or other portions) are typically formed with an obtuse angle therebetween The obtuse angle 30 permits the hanger 20 to support such garments in their natural form to enhance their appearance and extend their lifetime. For example, a hanger intended for support of coats might be configured with an obtuse angle 30 between 110 and 150 degrees. It should be appreciated that the structural features recited above (in particular, the flexible racks and the path segments along which they are guided) enable the arrangement of the arms 24, 26 with the desirable obtuse angle 30 therebetween.

Figure 5:
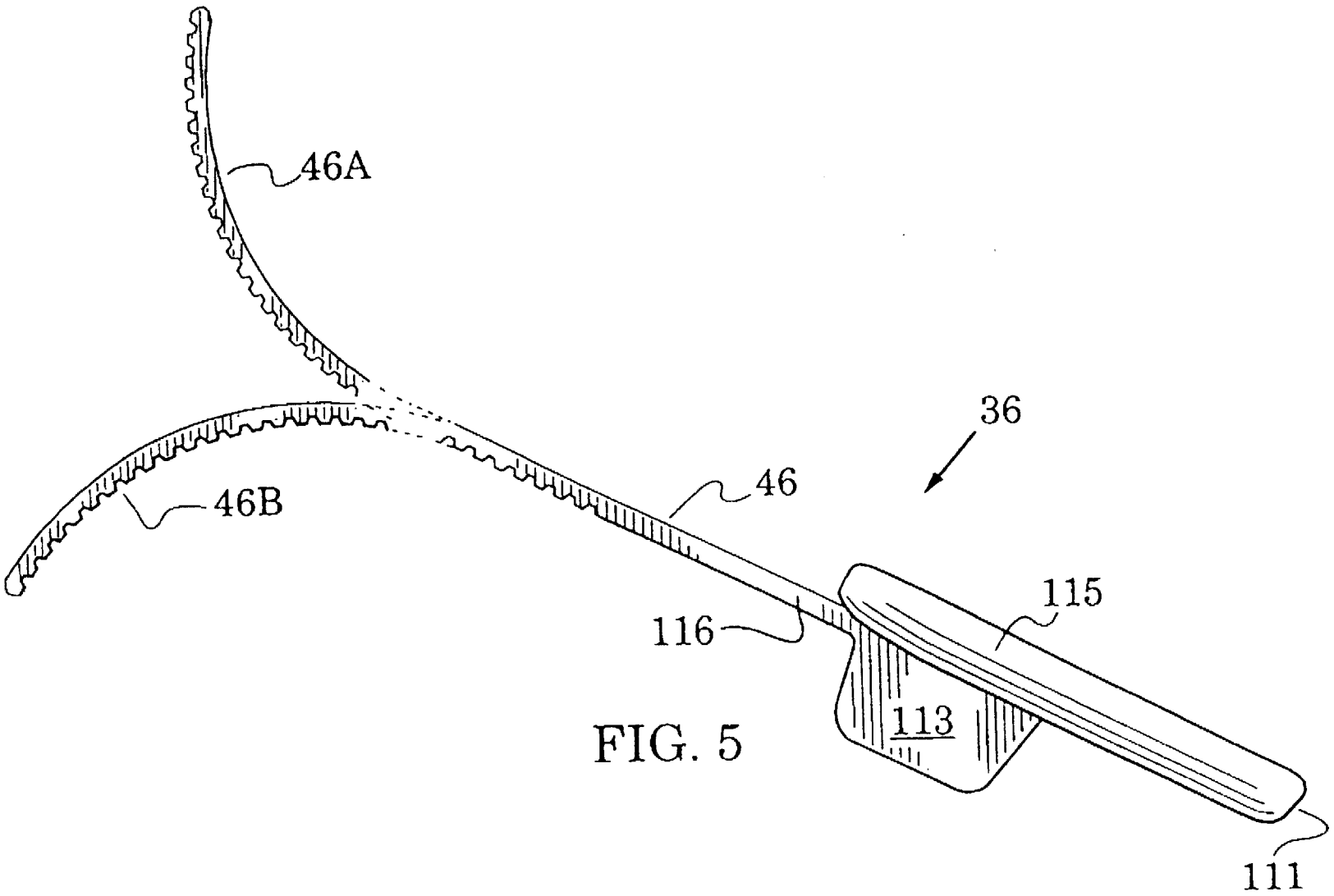
FIG. 5 is an elevation view of one of the extension members of FIG. 1 showing the flexibility of its rack.

The required rack flexibility is illustrated in FIG. 5 which shows the extension member 36 to have a garment abutting member 111, plate 113, and arcuate surface 115 similar to corresponding elements of the support member 34. The flexible rack 46 is bent upward to position 46A and downward to position 46B. The rack is preferably formed of a resilient polymer, e.g., polypropylene, and may be formed integrally with other portions of the extension member 36. Alternatively, the rack 46 can be formed separately and linked to the other elements of the extension member by any of the ways well known in the art, e.g., bonded or stapled along the base 116 of the tongue.

FIGS. 1 and 4 show a pawl 64 slidably mounted in the chamber 74 to selectively move between a first position engaging the pinion 50 and a second position spaced from the pinion 50. The end of the pawl 64 preferably defines spaced teeth 170 to facilitate this locking engagement. As shown in FIG. 4, the pawl 64 is carded on a pin 172 which slides in slots 174 in the frame 22. An exterior end of the pin 172 is provided with a knob 176 which allows a user to urge the pawl in and out of engagement with the pinion 50. When the pawl 64 is moved to the spaced position shown in FIG. 1, the pinion 50 is released for rotation and consequent translation of the extension members 34, 36 along their respective arms.

In an alternative embodiment, the position locking member 64 may be formed of an elastic or resilient material to provide a yielding tactile detent operation which locks the position of the extension members 34, 36 and yet allows lateral movement thereof when force above a predetermined threshold is applied. That is, lateral force applied on the extension members 34, 36 that exceeds the threshold causes the pawl to yield so that the pinion teeth 136 can slide over or click past the pawl 64 to settle into a new locking engagement relationship therebetween. A spring may be disposed between the pawl 64 and the frame 22 to urge the pawl 64 into its engagement or locking position. The spring's restoring force and/or the pawl material resilience can be selected in accordance with the desired threshold.

Although the position locking mechanism described above involved engagement of the pinion 50, locking members may be urged into a similar yielding engagement with other mechanism involved in the extension member translation such as one or both of the racks 44, 46.

In another preferred embodiment, parts of the garment hanger 20 can be designed to have moving friction therebetween so that the extension members 34, 36 remain fixed absent urging imposed on them by the hanger's user. For example, the passages 90, 96, 150 and 154 could be sufficiently restricted to yieldingly grip the racks passing therethrough. Such preferred embodiments would not require a locking member such as the pawl 64.

The garment hanger 20 is also provided with structure typically included in garment hangers. Specifically, the medial portion 52 extends upward to form a boss 180 which rotatably carries an arcuate hook 182 for suspending the garment hanger from various clothing supports, e.g., a closet rod. Additionally, the frame 22 defines a lateral rod 184 connecting the arm ends 75, 76 for supporting other garment items, e.g., slacks.

Figure 6:
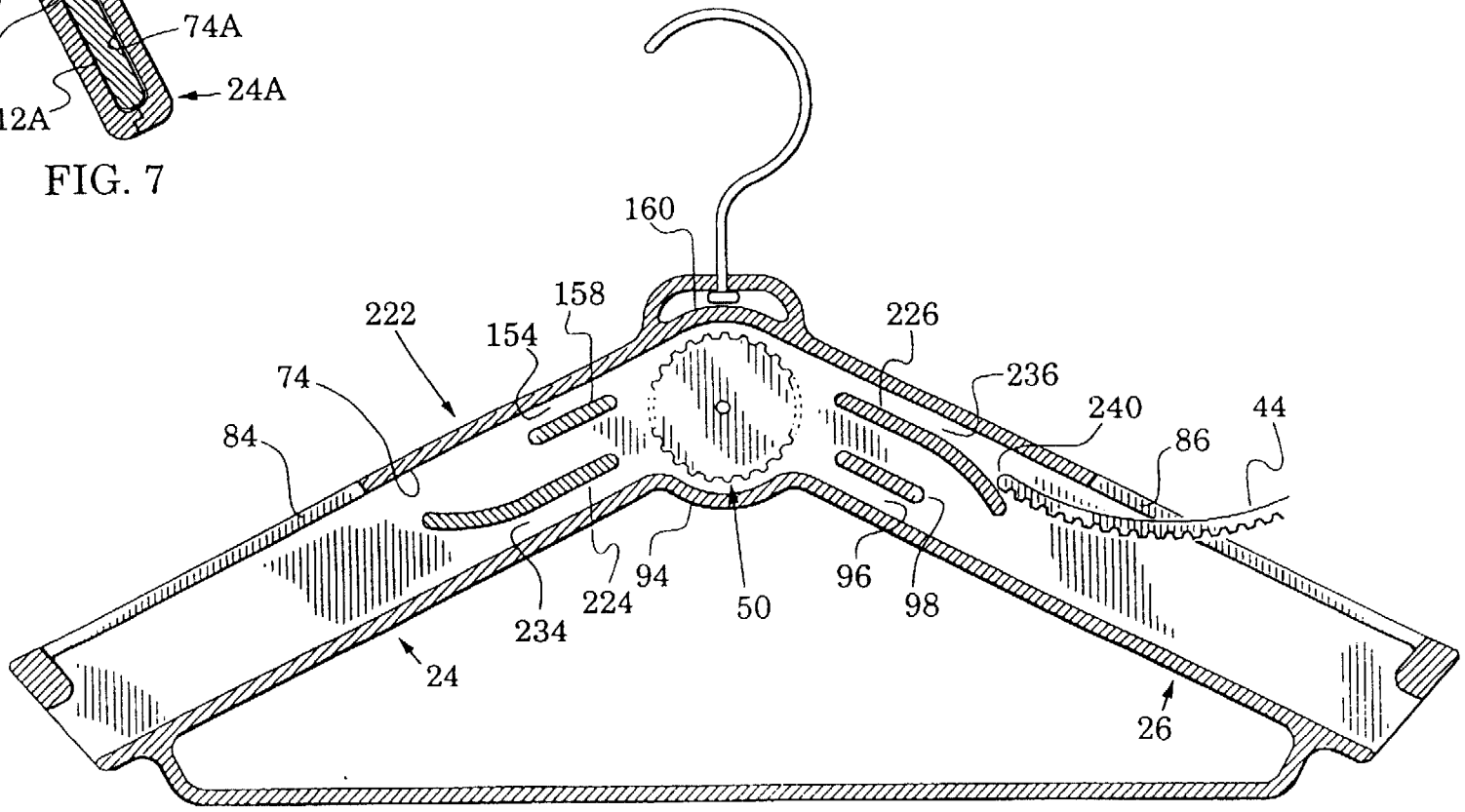
FIG. 6 is a view similar to FIG. 1 illustrating another preferred embodiment of the rack guides of FIG. 1.

FIG. 6 is a view similar to FIG. 1 illustrating another preferred rack guide embodiment. The frame 222 of FIG. 1 has a pinion 50 and bosses 98,158 similar to the frame 22. However, the bosses 92 and 156 of the frame 22 are replaced with bosses 224 and 226. The boss 224 extends further laterally and also curves away from the lower chamber wall 94. The boss 226 extends further laterally and also curves away from the upper chamber wall 160. Thus, the boss 224 and lower wall 94 defines a passage 234 that is spaced laterally from the pinion 50 and which widens as it approaches the slot 84. Similarly, the boss 226 and the upper wall 160 define a passage 236 that is spaced laterally from the pinion 50 and which widens as it approaches the slot 86.

In use, the passages 234, 236 facilitate inserting the extension members after fabrication of the frame 222. This is illustrated in FIG. 6 where the end 240 of the flexible rack 44 is shown to have been inserted through the slot 86 and into abutment with the boss 226. Obviously, as the rack 44 is now urged inward, the arcuate boss 226 will direct it through the passage 236, into engagement with the pinion 50 and on through the passage 154 between the boss 158 and the upper wall 160. It is apparent that insertion of the rack 44 (shown in FIG. 1) through the slot 84 will be similarly facilitated by the arcuate boss 224.

Figure 7:
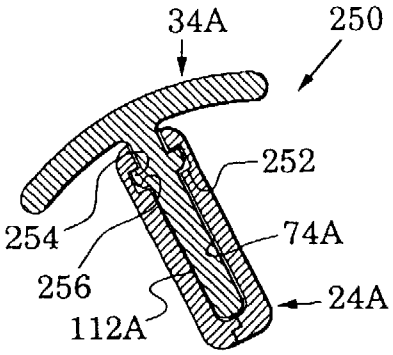
FIG. 7 is a view similar to FIG. 2 illustrating another preferred arm and extension member embodiment.

FIG. 2 illustrated an extension member 34 that is reciprocally carried along the arm 24 as indicated by the arrow 54 in FIG. 1. To facilitate this movement, a plate 112 descends from the extension member 34 to slide within the chamber 74 of the arm 24. FIG. 7 is a view similar to FIG. 2 illustrating another preferred hanger embodiment 250 in which an arm 24A has a chamber 74A that defines a pair of slots 252 in its inner walls. An extension member 34A has a plate 112A that defines a pair of ribs 254 which are each slidingly received within a different one of the slots 252. The corners 256 of the ribs 254 are beveled to facilitate pressing the ribs downward until they snap into the slots 252. The slots 252 and ribs 254 are directed along the direction of the arrow 54 of FIG. 1.

Thus, the extension member 34A is smoothly guided along the arm 24 by the sliding engagement between the ribs 254 and slots 252. Additionally, the slots 252 and the ribs 254 received therein inhibit removal of the extension member 34A from the arm 24A. Similar structure, of course, is provided for the other arm and extension member of the hanger embodiment 250.

Illustrated in FIGS. 8–11 is another preferred adjustable hanger embodiment 320 which includes a rotatable adjustment knob and an optional electric motor for respectively manually and automatically turning the hanger's rack pinion. Therefore, in the embodiment 320, the spacing of the extension members can changed by either manually rotating the adjustment knob or by simply moving an electrical switch.

Figures 8, 9, 10, 11A, 11B:
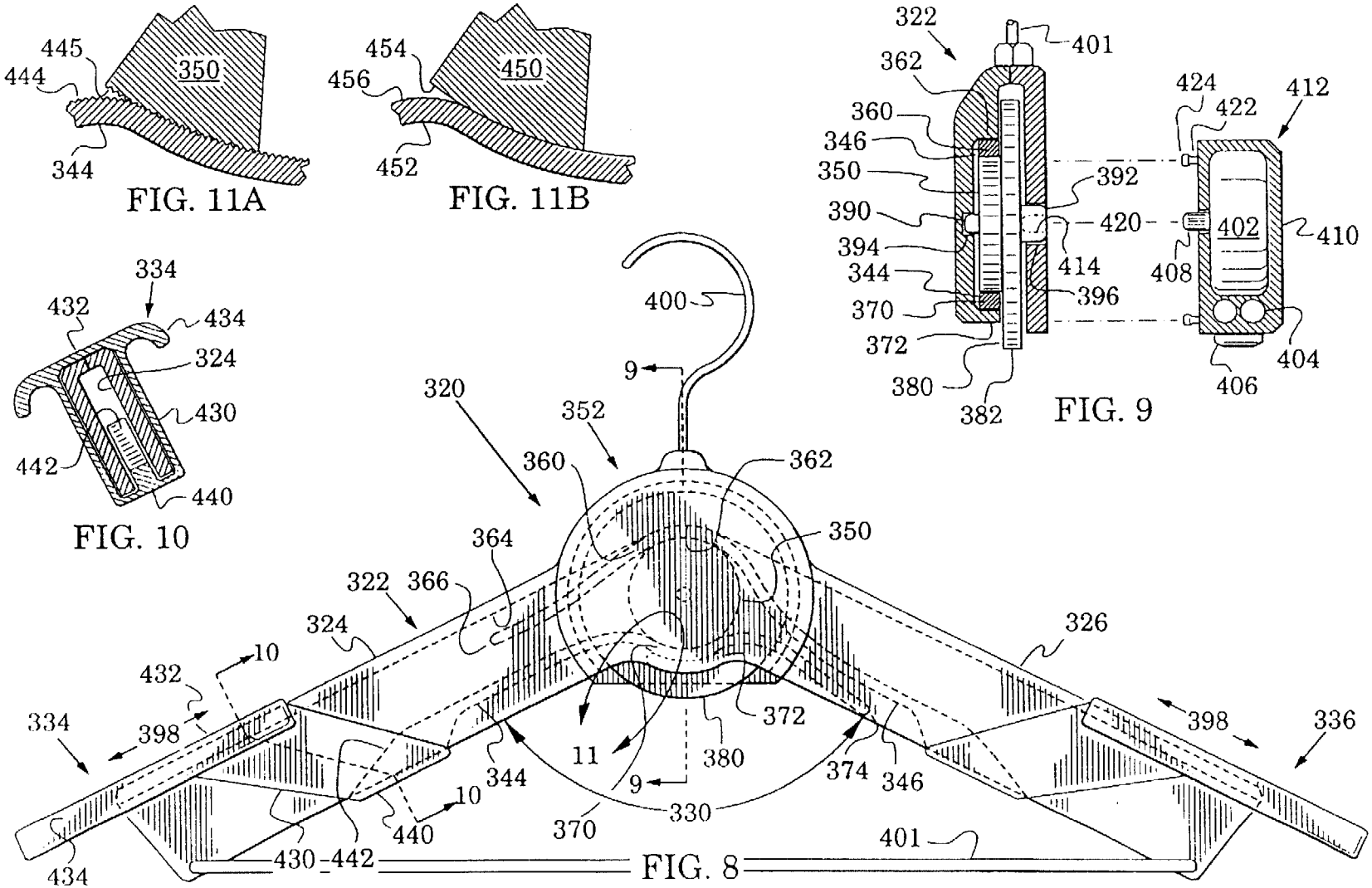
FIG. 8 is an elevation view of an another preferred adjustable garment hanger embodiment.
FIG. 9 is an enlarged view along the plane 9—9 of FIG. 8.
FIG. 10 is an enlarged view along the plane 10 of FIG. 8.
FIG. 11A is an enlarged view of the structure within the curved line 11 of FIG. 8.
FIG. 11B is a view similar to FIG. 11A.

FIG. 8, an elevation view similar to FIG. 1, shows that the hanger 320 includes a frame 322 having a pair of elongate support members in the form of arms 324, 326 which are arranged to define an obtuse angle 330 therebetween as in the hanger 20 of FIG. 1. The arms 324, 326 respectively carry slidable extension members 334, 336 and these extension members respectively have flexible racks 344, 346 extending therefrom.

The flexible racks 344, 346 are guided to engage a pinion 350 rotatably mounted at the frame's medial portion 352. The flexibility of the racks 344, 346 allow each of them to follow a respective guide path that is tangent to the pinion 350. As seen in FIG. 8 and in FIG. 9, which is an enlarged view along the plane 9—9 of FIG. 8, the flexible rack 346 extends inward from the extension member 336 and passes through a passage 360 formed between the pinion 350 and an overhanging arcuate lip 362 of the frame 322. The passage 360 guides the flexible rack 346 into engagement with the pinion 350. After passing over the pinion 350, the flexible rack 346 is guided along the lower surface 364 of the upper frame wall (the surface 364 transitions medially into the lip 362). Due to gravity, the end 366 of the flexible rack 346 may drop below the wall 364 as shown in FIG. 8.

In a similar manner, the flexible rack 344 extends inward from the extension member 334 and passes through a passage 370 formed between the pinion 350 and an outward extending arcuate lip 372 of the frame 322. The passage 370 guides the flexible rack 344 into engagement with the pinion 350. After passing through the passage 370, the flexible rack 344 is restrained by contact with the flexible rack 346 to travel beneath it and, due to gravity, the rack end 374 may drop beneath the rack 344 as shown in FIG. 8.

In the embodiment 320, the pinion 350 is formed integrally and coaxially with an adjustment knob 380 of greater diameter. The knob 380 has a knurled outer surface 382 which extends below the frame 322 to provide access thereto as shown in FIG. 8. The combined pinion 350 and knob 380 define axles 390, 392 which are rotatably received in journals 394, 396 defined in the frame 322.

In use, the knob 380 can be turned in either direction with finger or thumb pressure on the surface 382. This rotates the integral pinion 350 to either pull the flexible racks 344, 346 towards the medial portion 352 or push them away from the medial portion 352. Consequently, the extension members 334, 336 move reciprocally along the arms 324, 326 as indicated by the double headed arrows 398. Alternatively, the extension members 334, 336 may be moved reciprocally along the frame 322 by grasping them directly with the user's hands and urging them inward or outward as described above relative to the embodiment 20.

The garment hanger 320 can be suspended from a suitable clothing support with an arcuate hook 400 pivotably mounted in the medial portion 352. A rod 401 is shown mounted horizontally between the far ends of the arms 324, 326 to hold other garments, e.g., slacks.

FIG. 9 also illustrates an electric motor 402, a pair of batteries 404 and an electrical switch 406 for connecting the batteries 404 to the motor 402 for bidirectional rotation thereof. The motor 402 may contain gearing to drive its axle 408 in ways well known in the electric motor art. The motor, batteries and switch are enclosed in a housing 410 to form a motor assembly 412 from which the motor's axle 408 extends. The pinion axle 392 defines a recess 414. Both the motor axle 408 and the recess 414 define serrations to facilitate locking them rotatably when the axle 408 is received into the recess 414.

It is intended that the motor assembly 412 can be removably attached to the side of the frame 322 as indicated by the broken lines 420. Various well known attachment structures can be used. In an exemplary structure, the housing 410 includes molded feet 422 extending therefrom with an enlarged head 424. These feet 422 are received in sockets (not shown) conformingly molded into the hanger frame 322. The frame 322 and housing 410 are preferably formed from a resilient polymer so that the heads 424 are resiliently but removably held in the sockets of the frame 322. Thus, the hanger 320 can be provided with or without automatic actuation of the pinion 352 by quickly installing or removing the motor assembly 412. Simple operation of the switch 406 then commands bidirectional rotation of the pinion 350 with consequent movement of the extender members 334, 336 along the frame 322 as indicated by the arrow 398.

The frame 322 is generally U-shaped with an open bottom as best seen in FIG. 10 which is an enlarged view along the plane 10—10 of FIG. 8. The extension member 334 defines a sleeve 430 along the plane 9—9 which is slidably received over the frame arm 324. The upper chamber wall 432 defines a pair of oppositely directed arcuate shoulders 434 which are formed to conformingly support a garment The lower chamber wall 440 defines a flexible tongue 442 that rises within the U-shaped frame 322 and extends towards the frame's medial portion 352. The tongue 442 defines teeth on its further end to form the flexible rack 344 as shown in FIG. 11A.

FIG. 11A is an enlarged view of the structure within the curved line 10 of FIG. 8 and illustrates another preferred embodiment of the rack and pinion teeth. In this embodiment, the teeth are laterally oriented ridges 444 and 445 respectively formed in the flexible rack 344 and the pinion 350 to transmit forces between the pinion 350 and the rack 344. Although the ridges 444, 445 are shown to have a V-shaped contour, other ridge contours may be used to transmit force between the rack and pinion.

The teachings of the invention can be extended to other surface configurations suitable for transferring forces. FIG. 11B shows an exemplary embodiment in which a friction wheel 450 and a flexible tongue 452 respectively form frictional surfaces 454,456 for force transfer therebetween. For example, the surfaces 454, 456 can be textured to present a roughened finish to transmit forces along a vector tangent to the friction wheel 450. A frictional locking member may be arranged to selectively engage the wheel 450 to retain the extension members 334, 336 in a fixed position. For example, a locking member could be arranged similar to the pawl 64 of FIG. 1 to move a frictional surface thereof into engagement with the surface 380 of the wheel 350. When such a locking member is disengaged, the extension members 334, 336 are free to translate along their respective arms.

Figure 12:
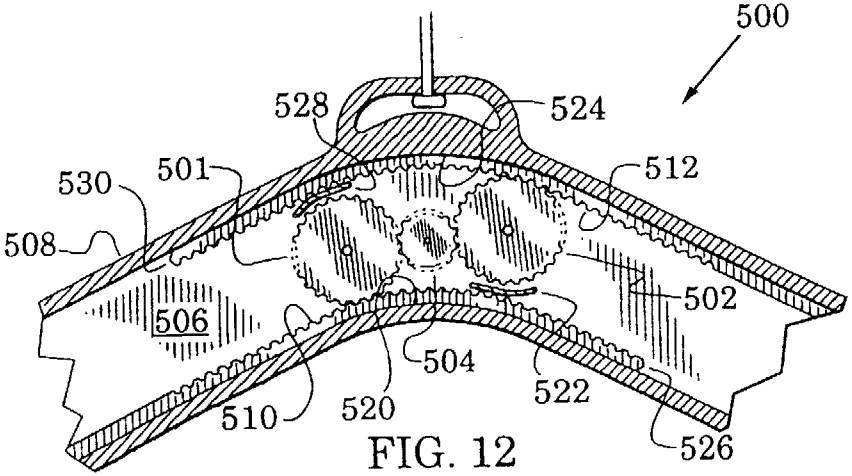
FIG. 12 is a view similar to the medial portion of FIG. 1 showing another preferred pinion embodiment.

The hanger embodiment 20 shown in FIG. 1 included a single pinion gear 50 having diametrically opposed sections in engagement with flexible racks 44, 46. Similar structure was disclosed relative to hanger embodiment 320 of FIG. 8. It should be understood that the teachings of the invention may be extended to the use of multiple pinion or spur gears for engaging the flexible racks. For example, FIG. 12 is a view similar to the medial portion of FIG. 1 showing a preferred hanger embodiment 500 in which a pair of pinions 501, 502 are laterally spaced to accommodate a smaller pinion 504 therebetween. The pinions 501, 502 engage diametrically opposed portions of the pinion 504.

The gears 501, 502 and 504 are mounted for rotation within the medial portion of a chamber 506 of a hanger frame 508. Flexible racks 510, 512 extend inward from extender members (not shown) to the medial portion where they each engage a different one of the pinions 501, 502. In particular, the rack 510 engages pinion 501 while sliding between the pinion and the lower chamber wall 520. A boss 522 prevents the rack 510 from moving upward to engage the pinion 502.

In a similar manner, flexible rack 512 engages pinion 502 and slides between the upper chamber wall 524 and a boss 526 to avoid engaging pinion 502. Mutual engagement with the central pinion 504 insures that the pinions 501, 502 rotate in the same direction with the same angular velocity. Thus, if the extension member attached to the flexible rack 510 were moved laterally inward along the frame 508, this movement would be translated through the pinions 501, 502 and 504 to cause a similar inward movement of the flexible rack 512. The ends 528, 530 of the racks 510, 512 are shown in contact respectively with the lower and upper chamber walls 520, 524 although they are, in fact, free to be spaced from these walls.

Figure 13:
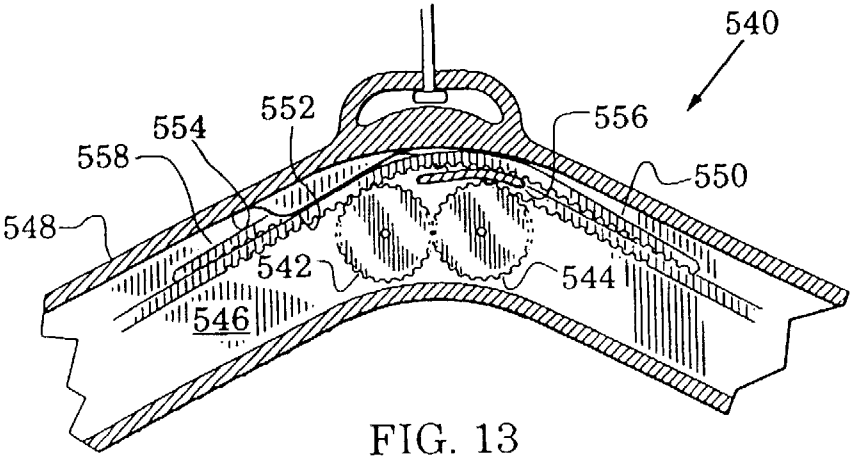
FIG. 13 is a view similar to FIG. 12 showing another preferred pinion embodiment.

Another preferred hanger embodiment 540 having multiple pinions is illustrated in FIG. 13. The hanger 540 has a pair of mutually engaged pinions 542, 544 rotatably mounted within the medial portion of a chamber 546 of a hanger frame 548. A flexible rack 550 extends from an extension member (not shown) inward to the medial portion where it engages the upper surface of pinion 542. The rack 550 is guided into this engagement by a boss 552 that descends from the upper wall 554 of the frame 548. Another boss 556 extends from the near chamber wall of the frame 548 to be located above the pinion 544 and spaced from the upper wall 554. After passing over the pinion 542 the rack 550 is guided between the boss 556 and the upper chamber wall 554. Thus the rack 550 is first guided into engagement with the pinion 542 and then guided away from engagement with the pinion 544.

Another rack 558 extends inward from the opposite extender member. The racks 550, 558 are each formed to have one half of less the width of the chamber 546 and the rack 558 passes behind the rack 550. Although not shown, bosses similar to the bosses 552, 556 are provided for guidance of the rack 558 into engagement with the pinion 544 and into a spaced relationship with the pinion 542. The boss similar to the boss 552 descends from the upper chamber wall 554 and is located rearward from the boss 552. The boss similar to the boss 556 extends inward from the rear chamber wall 564 and prevents the rack 558 from engaging the pinion 542. Thus, the rack 558 passes behind the rack 550 to engage the pinion 544 but be spaced from the pinion 542. In accordance with a feature of the hanger embodiment 540, the racks 550, 558 and their attached extension members, are symmetrical with respect to the hanger medial portion and can, therefore, be the same part. The two parts are simply reversed end for end and each slid into opposite ends of the frame 548.

Figure 15:
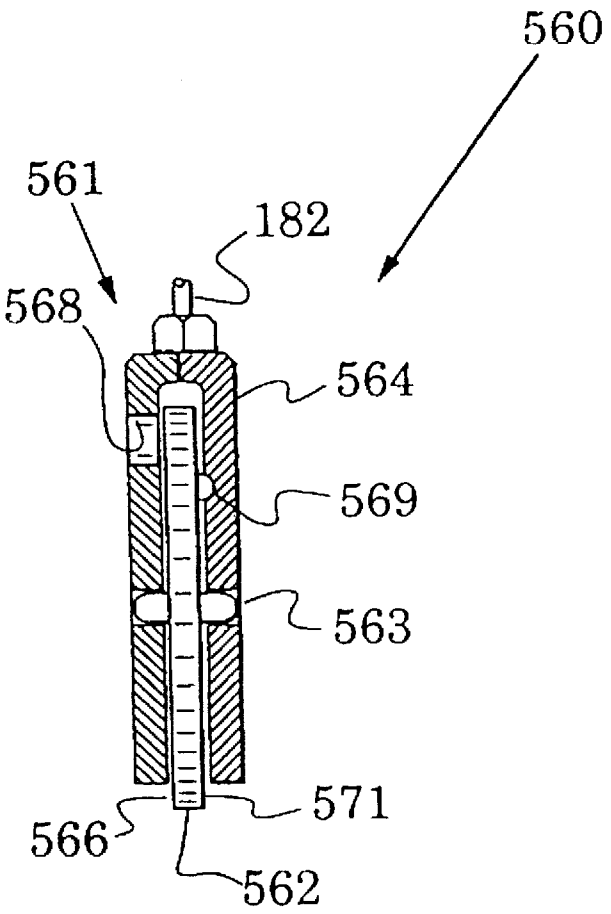
FIG. 15 is a side view of FIG. 14.
Figure 14:
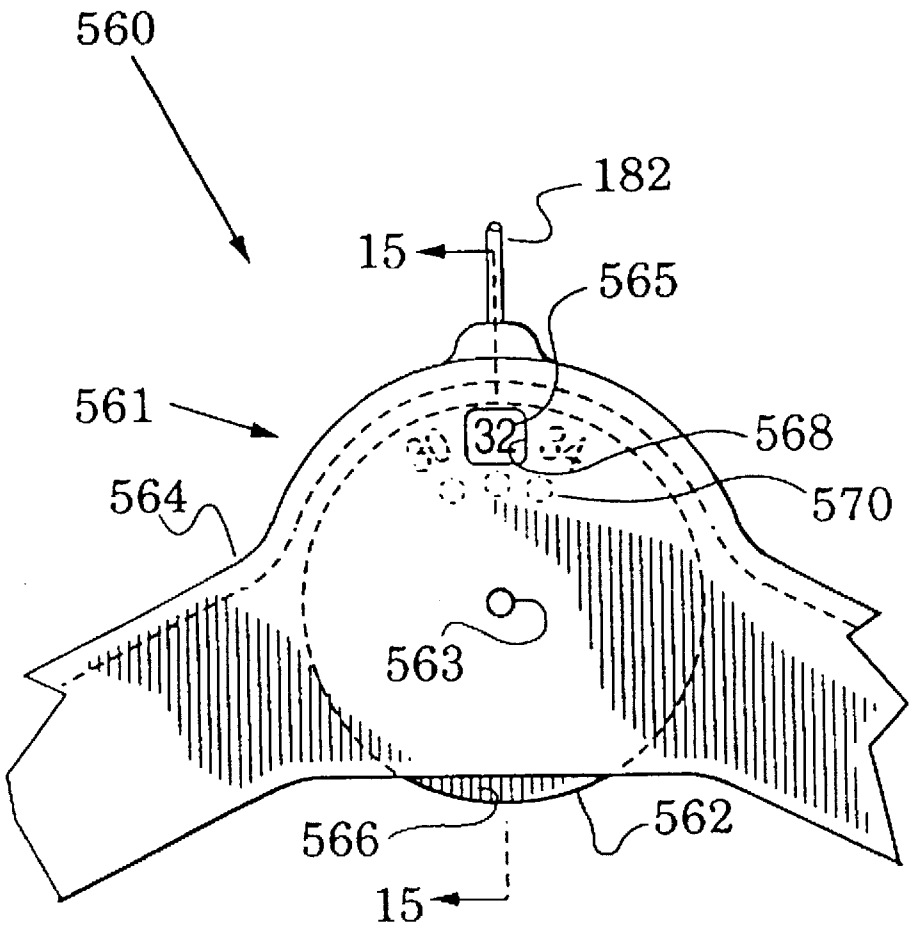
FIG. 14 is a front elevation view of a fixed hanger having a size indication apparatus in accordance with the present invention.

The medial portion of a fixed size garment hanger 560 is shown in the elevation view of FIG. 14 while FIG. 15 is a view along the plane 15—15 of FIG. 14. The hanger 560 has a size indicating mechanism 561 which includes a wheel 562 having an axle 563 rotatably carried within the frame 564. Garment size indicating indicia 565 is spaced from the perimeter of a face 566 of the wheel so that it may be selectively viewed through a window 568 in the frame 564. A detent ball 569 is disposed between the frame 564 and the wheel 562. The ball 569 is received into any of a plurality of indentations 570 arranged along an arc in the other face 571 of the wheel 562. The wheel 562 and/or the frame 564 may be of resilient material, e.g., plastic, to provide a yielding resistance to movement between detent positions. This yielding resistance may be enhanced by including a biasing spring in the mounting of the detent ball 569. The indentations 570 are arranged so that each detent position of the wheel 562 displays a different indicia 565 in the window 568.

In a first use, a garment can be hung on the hanger 560 and the wheel 562 rotated until the corresponding garment size is displayed in the window 568. The wheel 562 can be quickly rotated to display a new size indication when the garment is replaced with one of a different size. In commercial uses in clothing stores and the like where garments are changed repeatedly, the hanger 560 offers a savings in time and parts over garment size indicators that require more manual replacement operations and/or parts, e.g., collars bearing the size indicia that are received over the hanger hook 182.

In a second use, the size indicating mechanism 561 can be used to show the size of the fixed hanger itself. In this use, the garment hangers 560 could be manufactured in a variety of sizes and then the wheel 562 of each hanger 560 would be rotated to its appropriate size indicia 565. In this second use of the size indicating mechanism 561, the detent ball 569 could be replaced by a more permanent locking mechanism, e.g., a pin inserted through the frame 564 and wheel 562.

Although FIG. 14 shows numerical sizes, the size indicia 565 can be anything size indication appropriate to the intended garment such as S, M, L and XL, (for small, medium, large and extra large). The wheel 562 could be augmented with a second wheel to display sizes with a finer resolution, i.e., units and tenths of units.

In an adjustable garment hanger, the size indicating mechanism 561 shown in FIGS. 14, 15 can be coupled to the adjustment mechanism. For example, the size indicator of FIGS. 14, 15 can be combined with the adjustment knob and pinion of FIG. 8 to produce the preferred embodiment shown in FIG. 16. This figure and FIG. 17, which is a view along the plane 17—17 of FIG. 16, illustrate a viewing window 580 cut through the near wall 582 of the medial portion 352 to expose the near side 583 of the knob 380. Indicia 584 indicative of coat sizes is carried on the knob side 583. As described relative to FIG. 8, the knob 380 may be rotated to cause the pinion 350 to move flexible racks 344, 346 and their attached extension members 334, 336 in opposite directions. The size indicia 584 displayed through the window 580 then indicates the coat size to which the extension members have been adjusted.

FIG. 18 and FIG. 19, which is a view along the plane 19—19 of FIG. 18, illustrate another size indicator embodiment. These figures show that the near axle of the pinion 350 has been greatly enlarged. This enlarged axle 590 extends through an enlarged journal 592 in the medial portion 352 to expose the face 594 of the axle 590. The face 594 beam a marker indicia 596 in the form of an arrow while size indicia 598 are displayed on the near wall 600 of the medial portion 352. Thus, as the pinion 350 rotates to move the flexible racks 344, 346, it also rotates the arrow 596 to indicate an appropriate size indicia 598.

Another size indicator and adjustment embodiment is shown in FIG. 20 which is a view of the right arm 326 and right extension member 336 as shown in FIG. 8. In FIG. 20, the near side 610 of the arm 326 bears size indicia 612 and the extension member 336 has been shaped to form two sides of a display window 604. Thus, as the extension member 336 is moved to a new position on the arm 326, its window 604 indicates an appropriate coat size.

Figure 22:
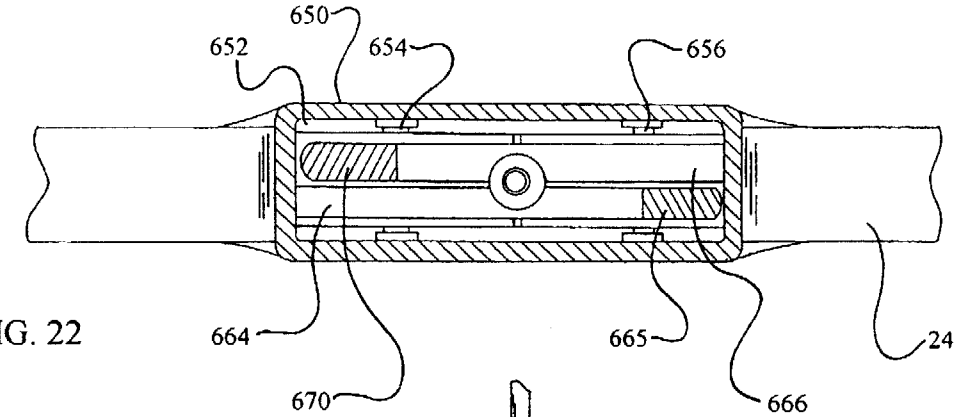
FIG. 22 is a sectional view along line 26—26 of FIG. 21.
Figure 21:
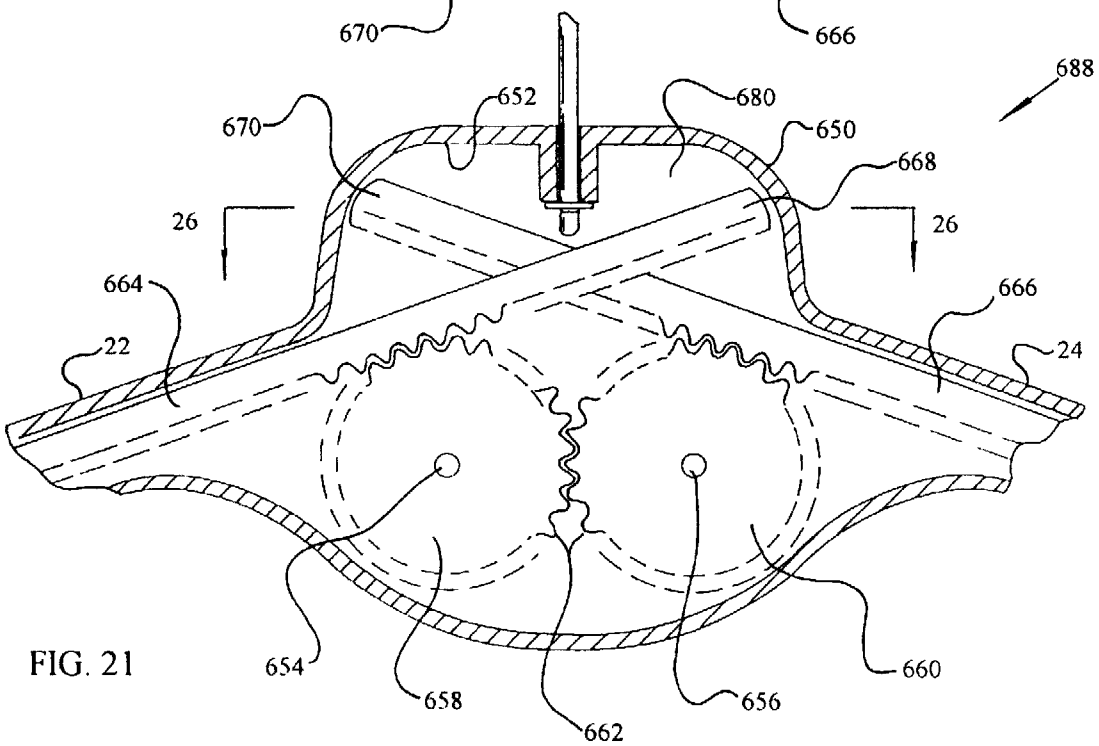
FIG. 21 is a partial sectional view of an alternative embodiment of the present invention.

FIGS. 21 and 22 illustrate the medial portion of a hanger otherwise constructed in a manner substantially similar to the hanger illustrated in FIG. 1. Accordingly, in FIG. 21 inner ends of the arms 22, 24 are shown extending outwardly from medial portion 650 defining a chamber 652 therein in which there are mounted wheels 658 and 660 for rotation about laterally spaced apart axes 654 and 656. Each wheel is provided with a plurality of peripheral teeth 662 which inter engage with the teeth of the other wheel so that rotation of one wheel 658 in one direction is effective to cause wheel 660 to rotate in an opposite direction by an equal amount.

Extension members (not shown in FIG. 21) are each provided with an elongate substantially nonflexible tongue 664 and 666 respectively. Each tongue is provided with a plurality of teeth 668 which inter engage with teeth 662 of a respective one of the wheels 658, 660 so that back and forth movement of either one of the tongues 664,666 is effective to drive the other tongue in an opposite direction by an equal amount. The end of each tongue remote from its respective extension member extends beyond its respective wheel so that the tongues cross over in the medial portion chamber 652 as illustrated in FIG. 21 and FIG. 22 when the extension members are proximate to their innermost position on the support arms. As shown in FIG. 22 the remote ends 668 and 670 of the tongues 664 and 666, respectively, are located side by side in the chamber 652. On top of the wheels 656, 658 is a room 680 which is provided to receive the tongues 664, 666.

In operation the extreme outer ends 668, 670 of the tongues 664, 666 are in their innermost position substantially adjacent the inner wall of the chamber 652 which will act as a stop for the inward movement of the tongues of the extension members. If the extension member connected to tongue 664 is physically moved outwardly wheel 658 is rotated in a counter clockwise direction and wheel 660 rotates in a clockwise direction forcing tongue 666 to move to the right in FIG. 21 by a corresponding amount until the outermost ends 668, 670 of the arms 664, 666, respectively, are in the region of the area of contact between the tongue and the respective wheel 658, 660. Also at this time extension members on arm 22 engages the end stop 224 to prevent further outward movement of the extension members and hence the tongues 664 and 666. The embodiment shown in FIG. 21 and FIG. 22 provides the advantage of rigid extension members, which are cheaper to manufacture. The symetrically structured extension members enhance the looking of the garment hanger as the tongues of both extension members are both located symmetrically on top of the transfer mechanism. The inclusion of supporting arms will be beneficial to reinforce the supporting strength of the extension members. In this situation, the support arm should provide mating guiding and locking structure to the respective extension member as described in the other relative embodiments with similar designs.

From the foregoing it should now be recognized that embodiments of an adjustable garment hanger have been disclosed herein especially suited for lateral adjustment to enhance the fit between a garment and its supporting hanger.

Apparatus in accordance with the present invention may be quickly adjusted to conform with each garment size. Different extension members can be shaped to conform to different garments, e.g., coats, dresses. The hanger can then be modified by slidably replacing its extension members with ones directed to a different garment. It should be understood that although embodiments have been disclosed having pairs of extension members moving in opposite directions from a medial frame portion, other embodiments may include only a single extension member disposed on one end of the hanger frame.

What is claimed is:

1. An adjustable garment hanger, comprising:

a suspension means;

a medial portion having a transfer mechanism;

first and second elongate extension members each defining an axis extending in different directions and mounted relative to said medial portion in an orientation to define an obtuse angle therebetween, each of the extension members coupled to said transfer mechanism for reciprocal translation of the extension member to travel in different directions; and each extension member having an inner end and an outer end, and wherein the movement paths of the inner ends of the extension members cross over each other's axis side by side at a location proximate to the medial portion to extend and form the obtuse angle.

2. The adjustable garment hanger of claim 1 characterized in that when force is applied on the first extension arm in the direction along the axis of the respective extension arm, the force is translated to the second extension arm for reciprocal motion of the second extension arm in opposite direction.

3. The adjustable garment hanger of claim 1 wherein: said transfer mechanism is at least one wheel and each of the extension members includes a tongue coupled to the wheel for reciprocal translation of the extension members.

4. The adjustable garment hanger of claim 3 further comprises means for guiding each of said tongues along a path that is tangent with the wheel for engagement thereof.

5. The adjustable garment hanger of claim 3 wherein said wheel includes a plurality of peripherally defined teeth; and each of the tongues defines a plurality of teeth.

6. The adjustable garment hanger of claim 1 wherein said obtuse angle is between 110 degree and 150 degree.

7. The adjustable garment hanger of claim 1 further comprising a knob coupled to said transfer mechanism to facilitate turning thereof by a user of the hanger.

8. The adjustable garment hanger of claim 1 further comprising a motor coupled to the transfer mechanism for turning thereof.

9. The adjustable garment hanger of claim 8 wherein said motor is removably coupled to the transfer mechanism for turning thereof.

10. The adjustable garment hanger of claim 1 further comprising:

first and second elongate support arms extending from said medial portion, supported relative to one another at an obtuse angle therebetween; and means for guiding the first and second extension member along their respective support arms.

11. The adjustable garment hanger of claim 1 further comprising locking means for selectively locking the first and second extension member translation.

12. The adjustable garment hanger of claim 11 said locking means further comprising means for yielding to forces applied to one of said extension members when the forces exceed a predetermined threshold.

13. The adjustable garment hanger of claim 1 further comprising means for inhibiting removal of the extension members from said hanger.

14. The adjustable garment hanger of claim 1 further comprising means for indicating the hanger size obtained by the reciprocal translation of the first and second extension members along their respective support arms.

15. The adjustable garment hanger of claim 3 wherein said transfer mechanism comprises of first and second wheels mounted for rotation on spaced apart axes and with peripheral coupling therebetween; the tongue of the first extension member is coupled to the peripheral of said first wheel and the tongue of the second extension member is coupled to the peripheral of said second wheel.

16. The adjustable garment hanger of claim 3 wherein said tongues are substantially non-flexible.

17. The adjustable garment hanger of claim 3 wherein each of said tongues comprises a flexible region.

18. A method of forming an adjustable garment hanger, comprising the steps of:

providing a suspension means;

providing and arranging first and second elongate extension members each having an axis to define an obtuse angle therebetween, each of said extension members having an inner end and an outer end, wherein said inner ends are mounted proximate to a medial portion;

mounting a transfer mechanism in operative association with said extension members for reciprocal translation movement of the extension members in different directions from each other and said medial portion for providing movement paths for the inner ends of the extension members to cross over each other side by side at a location proximate to the medial portion to form the obtuse angle.

19. The method of claim 18 further comprising the steps of:

arranging first and second elongate supporting arms extending from said medial portion, and providing means for guiding the first and second extension member to travel along their respective supporting arms.

20. The method of claim 18 further comprising the steps of:

mounting first and second wheels proximate to the medial portion; and couple said wheels with the inner ends of the extension members for reciprocal translation of the extension members to move in opposite directions.

21. The method of claim 20 further comprising the steps of:

forming the wheel to carry a plurality of peripherally defined teeth; and arranging a plurality of teeth on each of said inner ends of the extension members for engagement with the wheel teeth.

22. The method of claim 18 further comprising the steps of forming a room in the medial portion proximate to the top of said transfer mechanism to receive the inner ends of said extension members.

23. An adjustable garment hanger, comprising:

a suspension means;

a medial portion having a transfer mechanism;

first and second elongate extension members each defining an axis each having an inner end and an outer end extending in different directions mounted relative to said medial portion in an orientation to define an obtuse angle therebetween, each of the extension members couples to said transfer mechanism for reciprocal translation of the extension member to travel in opposite directions; and an enclosure located proximately above said transfer mechanism for accommodating the inner ends of each extension member when the extension members are positioned in their innermost location.

* * * * *